United States Patent [19]

Wilson

[11] 3,937,206

[45] Feb. 10, 1976

[54] BOWSTRING RELEASE MECHANISM

[76] Inventor: Hugh R. Wilson, 10840 SW. 120th St., Miami, Fla. 33176

[22] Filed: Jan. 9, 1975

[21] Appl. No.: 539,709

[52] U.S. Cl. ..... 124/35 A; 124/30 R

[51] Int. Cl.[2] ..... A41B 5/00

[58] Field of Search ..... 124/35 A, 23 R, 24 R, 11 R

[56] References Cited

UNITED STATES PATENTS

| | | | |
|---|---|---|---|
| 2,982,279 | 5/1961 | Pursley | 124/35 A |
| 3,527,194 | 9/1970 | Vadas | 124/11 R |
| 3,788,299 | 1/1974 | Mathews | 124/35 A |
| 3,845,752 | 11/1974 | Barner | 124/35 A |

*Primary Examiner*—Richard C. Pinkham
*Assistant Examiner*—William R. Browne
*Attorney, Agent, or Firm*—Salvatore G. Militana

[57] ABSTRACT

A bowstring release mechanism and, more particularly, a mechanism which incorporates an adjustable trigger. The trigger allows the trigger mechanism to be adjusted to a degree of sensitivity that will permit a spring mounted sear to releasably hold a rotatable bow string release member when the trigger mechanism has been actuated and has been removed from engagement with the sear.

5 Claims, 5 Drawing Figures

BOWSTRING RELEASE MECHANISM

The principal object of the invention is to provide a mechanism to be used in archery, to draw, hold, and release the string of a bow, in an accurate, precise manner.

A further object of the invention resides in the provision of a release wheel which features an escape notch and a flat locking surface on the circumference of said wheel and a pivoting sear block which bears against said flat locking surface on said wheel and a trigger block which bears against said pivoting sear block and thereby preventing movement of the sear block and wheel until the trigger is moved in the proper direction, said trigger having an adjusting screw to increase or limit the movement of the trigger. The energizing source for the releasing action of the mechanism is provided by the tension of the bowstring.

The user of a bow is confronted with the problem of releasing the bowstring and the arrow at precisely the instant when he is properly aligned with the target. It is of utmost importance that there be no movement of the hand that holds and releases the bowstring, that would cause a misalignment of the bowstring and the arrow with the target. This invention allows the user to release the bowstring by the movement of only one finger and the amount of said movement by the one finger can be reduced or increased by adjustment of the adjusting screw incorporated in the trigger. The bowstring may be held in the escape notch in the release wheel or the bowstring may be held by a rope or cable loop, said loop being held by the escape notch in the release wheel.

DETAILED DESCRIPTION

Figure 1:
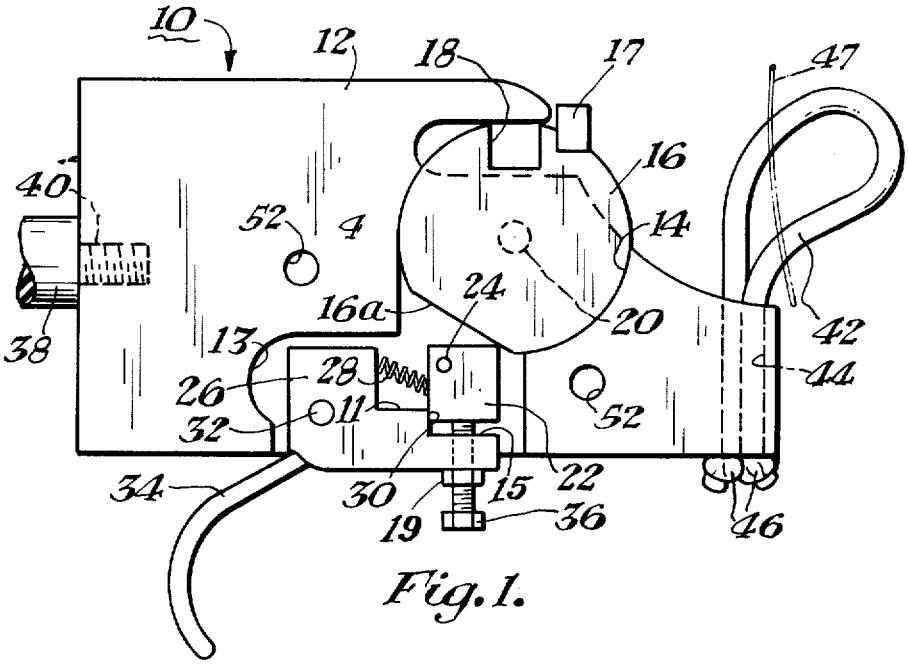
FIG. 1 shows the side view of the invention with the moving parts in the locked position. The sideplate is removed.

Referring to the drawing wherein like numerals are used to designate similar parts throughout the several views, the numeral 10 refers to a housing for my release mechanism having a plurality of communicating recesses 13 and 14 that extend through the bottom and front edges of the housing 10. A cover plate 48 is mounted over the side of the housing 10 by screws 50 threaded through bores 52 formed in the cover plate 48 and housing 10 to encase the trigger mechanism.

Within the recess 14 is a release wheel 16 pivoted at a pin 20 and having a peripheral notch 18 and a flat locking surface **16*a* on an opposite side thereof. Adjacent the notch 17 is a stop pin 17 mounted on the release wheel 16 and extending beyond its periphery. Within the recess 13 is a trigger block 26 pivoted therein as at 32 and having a trigger lever 34 attached thereon for pivoting the trigger block 26. The trigger block 26 is stepped as at 11 and 15 as shown by FIG. 1 for forming a shoulder 30 against which a sear block 22 engages as explained in detail hereinafter. The sear block 22 is pivotally mounted by a pivot pin 24 extending into the housing 10. A compressed coil spring 28 extends across the stepped portion 11 between the trigger block 26 and the sear block 22 to yieldingly force the sear block 22 to rotate in a counterclockwise direction as viewed in the drawing into constant contact relation with the release wheel 16 and to simultaneously rotate the trigger block 26 and lever 34 in a counterclockwise direction back to their cocked position. A trigger adjusting screw 36 that is threaded through the trigger block 26 engages the bottom surface of the sear block 22. The screw 36 is locked in position by a lock nut 19**.

A vertical bore 44 in the housing 10 receives a rope loop 42 that extends upwardly in the direction of the release wheel 16. The loop 42 is secured in the bore 44 by knotting its ends as at 46. A handle 38 is attached to the housing 10 by threading its end portion into a threaded bore 40 formed in the housing 10.

Figure 3:
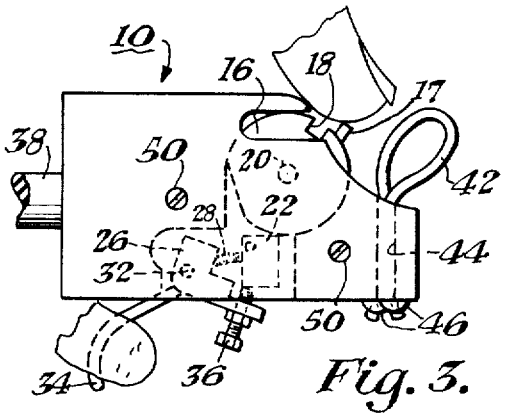
FIG. 3 is a side view showing the mechanism in the released or unlocked position. It also shows that the release wheel can be rotated by the thumb of the user to a locked or unlocked position.

To use the invention for the purpose for which it is intended, the user must first place the mechanism in the open or unlocked position, as shown in FIG. 3. If the mechanism is in the locked or closed position, FIG. 1, it may be easily opened by pressing on trigger lever 34 and pushing forward on release wheel stop pin 17 with the thumb. The rope loop 42 is then put around bowstring 47, FIG. 4. The loop is then tucked into the escape notch 18 of release wheel 16. With the loop rope 42 around the bowstring 47, and the loop then placed into the escape notch 18 of release wheel 16, the release wheel stop pin 17 is then grasped by the user's thumb and the release wheel 16 is then rotated counter-clockwise until release wheel stop pin 17 touches the end of the housing 12, FIG. 4. At this point, the flat locking surface **16*a* of release wheel 16 will allow pivoting sear block 22 under pressure of trigger spring 28, to rotate in a counter-clockwise direction and engage the flat locking surface 16*a* of release wheel 16. With the pivoting sear block 22 so engaged with the flat locking surface 16*a* of release wheel 16, clearance is provided bowstring the trigger block 26 to pivot in a counter-clockwise direction on pivot pin 32, under the pressure of the trigger spring 28, until trigger block 26 engages surface 30 of the pivoting sear block 22. At this point, the mechanism is in the closed or locked position as shown in FIG. 4 and also in FIG. 1**.

Figure 4:
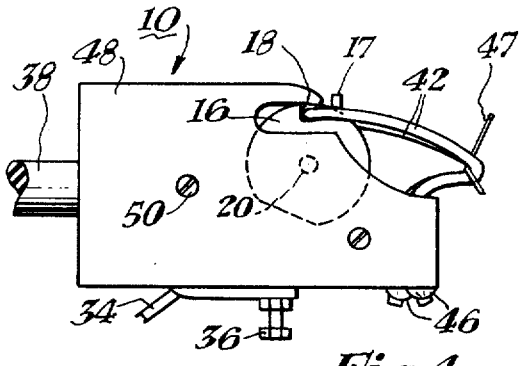
FIG. 4 shows the mechanism in the locked position with the loop secured in the escape notch of the release wheel and the bowstring held by the rope loop.

With the bowstring 47 thus secured in rope loop 42 and with rope loop 42 thus secured in escape notch 18 of release wheel 16, and with the mechanism in the closed or locked position, FIG. 4 and FIG. 1, the user now draws the bowstring back in the usual manner and aims. When the user is ready to release the bowstring 47 and therefore the arrow, he exerts pressure on trigger lever 34 of trigger block 26, said finger pressure on trigger lever 34, causing trigger block 26 to pivot in a clockwise direction on pivot pin 32 until the trigger block 26 no longer engages surface 30 of pivoting sear block 22. The energizing tension of the bowstring 47 which is transmitted to the release wheel 16 through the medium of rope loop 42 pulling on escape notch 18 of the release wheel 16, causes release wheel 16 to rotate in a clockwise direction, said release wheel 16 pushing downward on the corner of pivoting sear block 22 and causing said pivoting sear block 22 to pivot in a clockwise direction until flat locking surface **16*a* of release wheel 16 no longer bears on the corner of pivoting sear block 22 and allows release wheel 16 to continue to rotate in a clockwise direction until escape notch 18 has emerged from the slot in housing 10, FIG. 3, exposing the open end of the escape notch 18 and allowing the rope loop 42 to escape the escape notch 18 and thereby release bowstring 47**.

Figure 2:
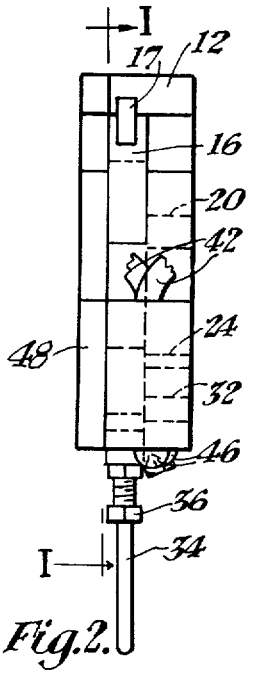
FIG. 2 is an end view of the same, with sideplate shown mounted thereon.
Figure 5:
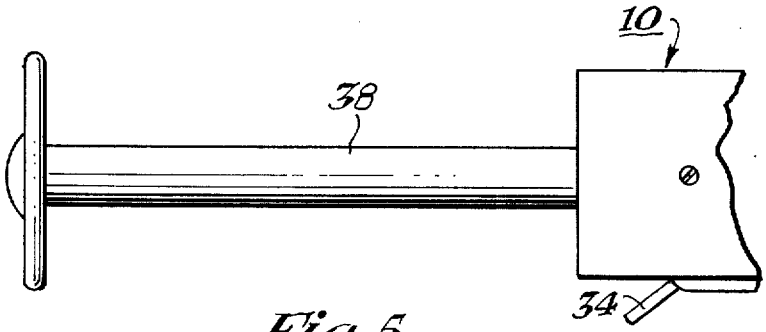
FIG. 5 shows the handle by which the mechanism is held by the hand of the user.

Although the foregoing describes the use of a rope loop 42, the bowstring 47 may be placed directly into escape notch 18 of release wheel 16 and be drawn and released in the manner previously described. As the construction of this invention requires only one finger and the thumb to secure it to the bowstring and to operate the release mechanism, it may be used by a right- or left-handed person, using only one hand for the release mechanism and leaving the other hand free to hold the bow. The moving parts of the mechanism are enclosed by the recess in the housing and a sideplate 48, or cover, that conforms to the shape of the housing and fits against the surface of the housing 1 in FIG. 2, and is secured by the two screws, 50, in holes 52. The movement of the trigger block 26 is regulated by the adjusting screw 36 and the distance that the trigger lever 34 must be moved to disengage the trigger block 26 with surface 30 of the pivoting sear block can be reduced or increased by the inward or outward turning of screw 36. A lock nut is provided, FIG. 1. The handle 38 shown in FIG. 5 provides a firm, comfortable grip for the user. The invention is not limited to the use of the handle 38 shown in FIG. 5 and different handles of a shape to meet the requirements of the individual user can be attached to the housing 10 by means of the threaded hole 40 shown in FIG. 1.

The rope loop 42 is secured from pulling through hole 44 by the knots 46 tied in the rope ends.

I claim as my invention:

1. A bowstring release device comprising a housing, a bowstring release member rotatably mounted in said housing, a trigger block pivotally mounted in said housing in spaced relation to said release member, a lever secured to said trigger block for manually pivoting said trigger block, a sear pivotally mounted in a space between said release member and said trigger block, shoulder means mounted on said trigger block for engagement by said sear when said trigger block is in a cocked position, spring means connecting said sear and said trigger block and yieldingly urging said sear into substantially constant contact with said release member when the trigger block is in an uncocked position to act against the rotational movement of said release member when said trigger block is in an uncocked position, upon pivotal movement of said trigger block to its uncocked position said shoulder means swings out of contact with said sear to permit the rotational movement of said release member under force of a released bowstring.

2. The structure as recited by claim 1 wherein said release member is cylindrical in shape pivoted at its axis, said release member comprises a flat surface formed on the periphery thereof, and said sear having an edge portion for engaging said flat surface.

3. The structure as recited by claim 2 further including an adjustable means mounted on said trigger block for engaging said sear so that the amount of force required to pivot the trigger block to swing the shoulder means out of contact with the sear may be varied.

4. The structure as recited by claim 3 wherein said adjustable means comprises a threaded bolt, said trigger block having a threaded bore receiving said threaded bore, said bolt engaging said sear when said sear and said trigger block return to their cocked position.

5. The structure as recited by claim 4 taken in combination with loop means mounted on said housing holding a bowstring during a cocking operation, a notch formed on said release member for receiving said loop means, and a stop pin mounted on said release member adjacent said notch for limiting the rotational movement of said release member.

* * * * *

UNITED STATES PATENT OFFICE

CERTIFICATE OF CORRECTION

Patent No. 3,937,206 Dated Feb. 10, 1976

Inventor(s) Hugh R. Wilson

It is certified that error appears in the above-identified patent and that said Letters Patent are hereby corrected as shown below:

On line 44 of column 2, --for-- is substituted for "bowstring".

Signed and Sealed this

Third Day of August 1976

[SEAL]

*Attest:*

RUTH C. MASON
*Attesting Officer*

C. MARSHALL DANN
*Commissioner of Patents and Trademarks*